US006468192B1

(12) United States Patent
Doerscheln

(10) Patent No.: US 6,468,192 B1
(45) Date of Patent: Oct. 22, 2002

(54) FRAME FOR BODY STRETCHING EXERCISES

(76) Inventor: Fred Doerscheln, 2755 County Rd. 37, Bloomfield, NY (US) 14469

( * ) Notice: Subject to any disclaimer, the term of this patent is extended or adjusted under 35 U.S.C. 154(b) by 0 days.

(21) Appl. No.: 09/465,677

(22) Filed: Dec. 17, 1999

(51) Int. Cl.[7] ..... A63B 26/00
(52) U.S. Cl. ..... 482/142; 482/143
(58) Field of Search ..... 482/37, 38, 142–144, 482/907, 140; 606/241, 244–245; 602/32, 36

(56) References Cited

U.S. PATENT DOCUMENTS 4,609,193 A * 9/1986 Paris et al. ..... 272/145
4,703,929 A * 11/1987 Reed ..... 272/144
4,867,143 A * 9/1989 Morin ..... 128/75
5,232,426 A * 8/1993 Van Straaten ..... 482/123
5,665,042 A * 9/1997 Breaux ..... 482/142
5,922,011 A * 7/1999 Cuccia ..... 606/241

FOREIGN PATENT DOCUMENTS

FR 02-315 291 * 1/1977 ..... 482/742
SU 0400336 * 2/1974 ..... 482/142
SU 1644-982 A * 4/1991

* cited by examiner

*Primary Examiner*—Denise M. Pothier

(57) ABSTRACT

A frame for body stretching exercises comprising a pair of U-shaped tubular legs hinged together at their open ends to form a support with their bight portions opposite from their open ends, detent means for limiting the separation of the legs when they are opened by spreading their bight portions apart, an upper generally U-shaped frame hinged to the legs at their open ends, and body supports extending across the legs and across the frame. Detent means are included to maintain the upper frame in co-planar alignment with one of the legs when the upper frame is extended, the frame may be released and swung to lie substantially co-extensively with the legs.

3 Claims, 2 Drawing Sheets

FRAME FOR BODY STRETCHING EXERCISES

This invention relates to a frame for body stretching exercises, and, more particularly, to a frame of this kind that is relatively simple in construction, and easy and comfortable to use.

BACKGROUND OF THE INVENTION

The importance of stretching the body prior to undertaking strenuous physical exercise is increasingly recognized nowadays, especially among physical trainers and therapists. It is now believed that adequate stretching of key muscle groups will aid in avoiding many injuries relating to tight, spastic, and imbalanced muscular conditions. The importance of body flexibility and its relationship to athletic performance and injury avoidance has been long ignored, but recently seems to be increasingly appreciated. In addition, body stretching alone, even when not followed by other exercise, is believed to be beneficial to maintaining health.

Many exercise devices are currently offered on the market, but none of those known to applicant appear to be suitable for stretching exercises; they all appear to be designed for what might be called endurance, or muscle building. Certainly none of them are promoted for well rounded body stretching.

The device of the present invention is intended to fill this need, and is an inexpensive, compact piece of equipment that will be found useful by sports trainers, chiropractors, physical therapists, and all persons engaged in strenuous exercise. This new device allows users to reduce the incidence of injury, and to speed recovery by fully stretching key muscles, thus filling an important gap in the exercise regimen of everyone from professional athletes to older people who want to improve their muscular-skeletal health.

The device of the invention allows the user to stretch arms, chest, all portions of the back, and the legs, obliques, lats, quadriceps, abdomen and rectus abdominal muscles in various prone and supine positions. It has also been reported by therapists to be invaluable in the rehabilitation phase of an injury, as it appears to aid in restoring joint mobility.

BRIEF DESCRIPTION OF THE INVENTION

Briefly, the stretching device of the invention somewhat resembles an artist's easel combined with an army cot. It comprises two pairs of legs, front and back, hinged together at their upper ends like the legs of a sawhorse, and a generally rectangular U-shaped frame, denoted here the upper frame, hinged on the front legs and extending upwardly in the plane of the front legs when unfolded.

Body supports are rotatable on the rear and front legs and the upper frame, extending transversely across the exercise device for partially supporting the user's body during use.

The device is also preferably collapsible for ease of transport or for storage. The rear legs and the upper frame simply fold upon the front legs, resulting in a compact, flat, and easily handled assembly.

BRIEF DESCRIPTION OF THE DRAWINGS

A presently preferred embodiment of the invention will now be described in detail in conjunction with the accompanying drawing, wherein.

DETAILED DESCRIPTION OF THE INVENTION

Figure 1:
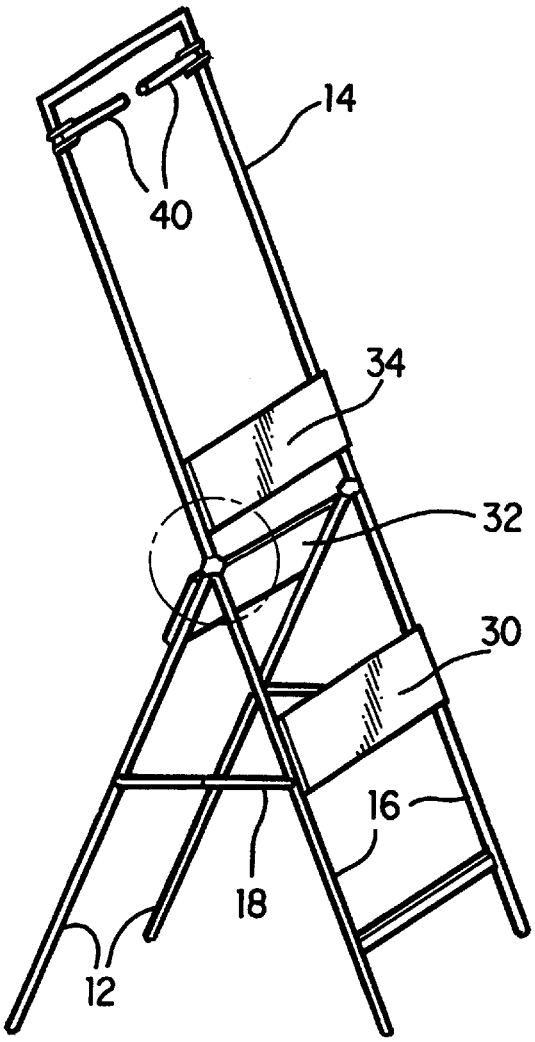
FIG. 1 is an isometric view of an exercise device according to a presently preferred embodiment of the invention showing the device in its extended position.
Figure 2:
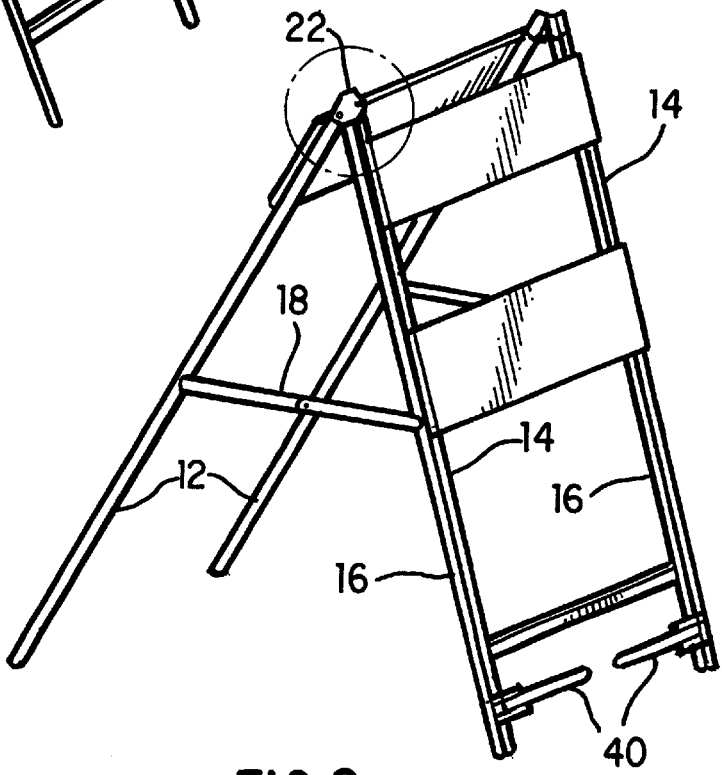
FIG. 2 is an isometric view of the device in its semi-collapsed position as it would be set up for stretching with the user in a bent over position.

Referring now to the drawings, FIG. 1 shows the device fully extended. The rear legs 12 and the upper, U-shaped frame 14 are hinged to the front legs 16 at the top thereof. Detent means formed by a pair of folding brackets 18 are connected between the rear and front legs 12 and 14, respectively, for limiting their extension so they can stand as an A-frame.

All of the members may be made of any desired material having adequate strength. As shown, they are made of steel tubing of about one inch square cross-section. Typically, the legs 12 and 16, and the frame 14 are each about 50" long and about 18" wide overall.

Figure 4:
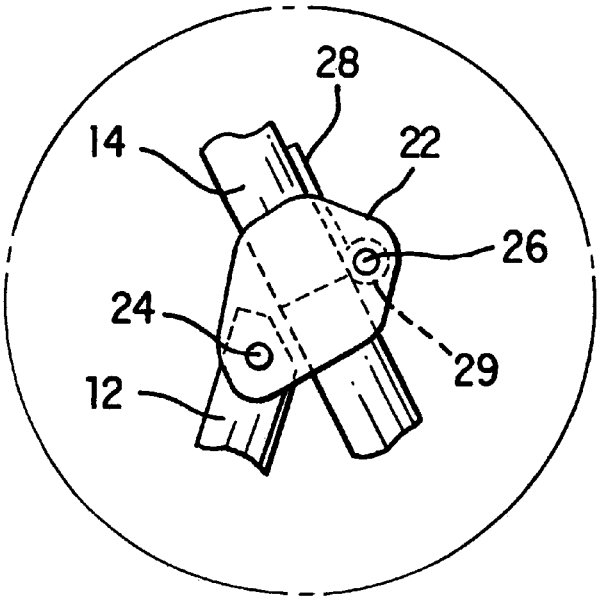
FIG. 4 is a side elevational view on an enlarged scale of the hinge arrangement presently used to connect the upper frame to the front and rear legs.

The presently preferred hinge construction is shown in detail in FIG. 4. It includes a pair of ear-shaped tabs 22 welded at the top to the sides of each front leg and extending both fore and aft of the leg. The tabs 22 are pierced to accept a hinge pin 24 for connection to the rear legs 12 and a hinge pin 26 for mounting the upper frame 14. The hinge pins 24 are spaced rearwardly of the front legs to allow the swinging motion required for alternately extending and folding the rear legs. In the case of the rear legs 12 the hinge pin passes through the side walls of the tubing, and the upper ends of the legs are chamfered to avoid interference with the front legs during opening and closing. In the case of the upper frame 14 a single hinge plate 28 is welded to the front wall of each leg of the frame with its pin-accepting curl 29 lying slightly beyond the end of the frame leg. The upper ends of the front legs 16 and the lower ends of the frame legs are orthogonal to their lengths, and the curl 29 of the hinge plate is positioned so that when the frame 14 is fully extended the ends of the confronting legs are in registration with each other, and the hinge pins restrain them from further swing beyond the point at which the upper frame 14 comes into alignment with the plane of the front legs 16 co-planar with them.

Figure 3:
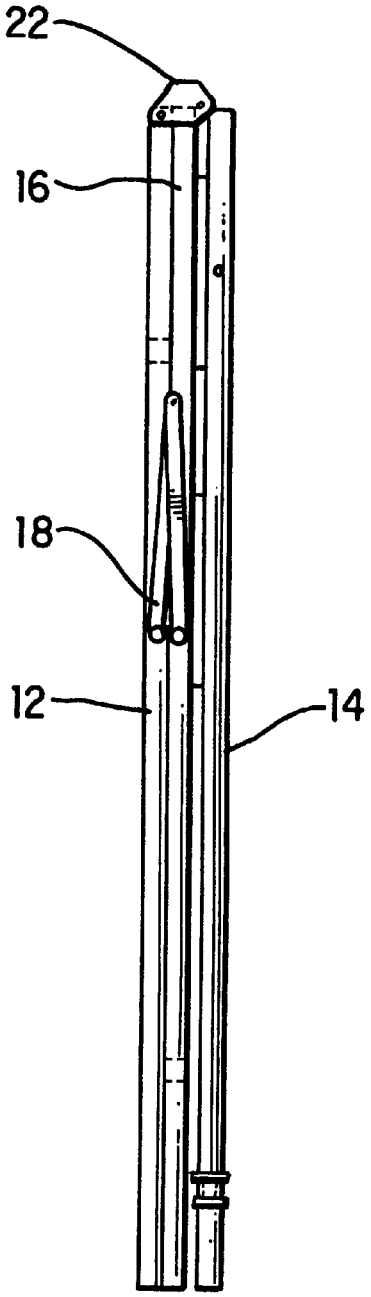
FIG. 3 is side elevational view of the device in its fully collapsed condition.

FIG. 3 shows the device in its collapsed position with the rear legs 12 lying against the rear of the front legs 16, and the upper frame 14 lying against the front of the front legs 16, making a compact package.

Body supports 30, 32, and 34 (FIG. 1) are pivoted respectively between the front legs 16, between the rear legs 12, and between the legs of the upper frame 14 for taking part of the weight of the user. The supports are centrally pivoted to let them tip about a horizontal axis to adjust readily to the needs of the user for maximum comfort. Each of the supports consists of a cushion secured in a relatively rigid tray (not separately shown or referenced) or otherwise strengthened adequately to avoid undue sagging. The cushions are relatively soft and yieldable for comfort, but basically rigid and not readily deformable beyond the desired cushioning effect.

A pair of handles 40 are adjustably positioned on the legs of the upper frame 14 for gripping by the user and thereby supporting himself on the device. His body weight then provides the stretching force, hanging on the handles 40 and partly resting on the supports. The handles 40 are the means for adjusting the device to accommodate height differences among different users. As shown they are of the rotation gripping type, being easily slidable along the legs of the frame when they are pushed or pulled in translation, and gripping the legs with a seizing action when pushed or pulled in rotation in the plane of the frame 14.

FIG. 3 shows the device with only the upper frame 14 folded, the rear legs 12 being extended. In this configuration the device is used for stretching the hamstring muscles, with the user bent over as though picking up something he dropped.

The dimensions, materials, and other aspects of the invention may be varied substantially. For, example, the legs 12 and 16 and the upper frame 14 maybe made of any desired material of adequate strength such as metal tubing of round cross-section, or wooden dowels. For people within the normal range of height and strength the front legs may be about fifty inches long, also the back legs and the upper frame. And the inclination of the front legs 16 relative to the vertical direction is not critical and may be chosen within a fairly wide range according to designer's choice in view of with the anticipated needs and preferences of the ultimate user.

As for inclination, in the inventor's experience any angle within about 10° either way of 45° from the vertical seems to be acceptable for most people, and, based on personal experience to date 45° seems to be about optimum for people in the so-called normal range of size and strength.

Of course, for others different dimensions may be preferred. For example, a professional basketball player, presumed to be extraordinarily tall and strong, may require a longer than normal upper frame, and be better satisfied with a steeper inclination. And a chubby, sedentary individual, although satisfied with the normal fifty-fifty-fifty inch lengths, may be happier with a flatter inclination, say about 55° or even 60° from the vertical direction.

It has been suggested that the device of the invention be made adjustable both in overall length and inclination, but it is believed that this modification would not likely be cost effective when the likely commercial demand is considered.

When the user simply faces the device, leans toward it, grasps the handles 40, supporting himself primarily by the handles, with his feet clear of the floor, he is in prone position stretching his arms, shoulders, trapezius and rhomboid muscles of the upper back, and the erector spinae, pelvic extensors, and lower back.

When he rolls over he will stretch the arms, deltoids (shoulder) pectoralis major and minor (chest) abdominals, and all quadriceps femoris (quads) muscles.

In the lateral position, one side against the supports 40 and both hands grasping one of the handles, the user stretches the latissimus dorsi (lats) the anterior serratus, abdominal obliques, gluteus medius and minimus, tensor fascia lata, and the lateral thigh muscles.

The device has been received with enthusiasm by chiropractors and by orthopedic surgeons who urge athletes and others to spend at least twenty minutes stretching before going into action. It appears that with the present relatively simple frame highly beneficial stretching can be accomplished.

What is claimed is:

1. A body stretching device comprising:

a pair of front legs, a pair of rear legs, said legs of each pair being spaced apart a predetermined distance and parallel to each other, hinge means connecting said rear legs to said front legs so that the rear legs may be swung alternately into and out of confronting engagement with said front legs, means connecting said front legs to said rear legs for limiting their motion away from each other so they may be spread apart a limited distance and stand as an A-frame, an upper U-shaped frame having parallel arms spaced apart at substanitally the same predetermined distance as said pairs of front and rear legs, said hinge means also including means for hingedly connecting the distal ends of the arms of said upper frame to ends of said front and rear legs and for releasably locking said upper frame in fixed position relative to said front legs and extending therefrom in co-planar relation therewith, the upper frame being swingable when it is released into confronting engagement with one of said pairs of legs, body supports extending respectively between said front legs and between said rear legs and between said arms of said upper frame for partially supporting a user of the device, and a pair of handles, one on each of said arms of the upper frame, adjustable along the length thereof and positionable thereon for grasping by a user.

2. A device according to claim 1 wherein said body supports include cushions.

3. A device according to claim 1 wherein said body supports are pivot for limited tilting about axes extending through the supports and normal to the respective front and rear legs and arms.

* * * * *